US008956180B2

(12) United States Patent
Kobayashi et al.

(10) Patent No.: US 8,956,180 B2
(45) Date of Patent: Feb. 17, 2015

(54) FPC CONNECTOR

(75) Inventors: Yasuaki Kobayashi, Kanagawa (JP); Shinsuke Kunishi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 487 days.

(21) Appl. No.: 13/320,874

(22) PCT Filed: May 19, 2010

(86) PCT No.: PCT/IB2010/001378

§ 371 (c)(1), (2), (4) Date: May 18, 2012

(87) PCT Pub. No.: WO2011/154758

PCT Pub. Date: Dec. 15, 2011

(65) Prior Publication Data

US 2012/0225579 A1 Sep. 6, 2012

(30) Foreign Application Priority Data

May 19, 2009 (JP) ..... 2009-120778

(51) Int. Cl.

| | |
|---|---|
| ***H01R 12/24*** | (2006.01) |
| ***H01R 12/77*** | (2011.01) |
| ***H01R 12/79*** | (2011.01) |
| *H01R 12/71* | (2011.01) |

(52) U.S. Cl.

CPC ..... *H01R 12/774* (2013.01); *H01R 12/79* (2013.01); *H01R 12/714* (2013.01)

USPC ..... 439/492; 439/267

(58) Field of Classification Search

CPC ..... H01R 12/774; H01R 12/714; H01R 12/79

USPC ..... 439/259–267, 492–499

See application file for complete search history.

(56) References Cited

U.S. PATENT DOCUMENTS

| | | | | |
|---|---|---|---|---|
| 8,038,467 | B2 * | 10/2011 | Shen et al. | 439/495 |
| 8,123,550 | B2 * | 2/2012 | Hoshino et al. | 439/495 |
| 8,579,654 | B2 * | 11/2013 | Chen et al. | 439/495 |

FOREIGN PATENT DOCUMENTS

| | | |
|---|---|---|
| JP | 1998-284053 | 4/2000 |
| JP | 2004-2791029 | 4/2006 |

* cited by examiner

*Primary Examiner* — Khiem Nguyen

(74) *Attorney, Agent, or Firm* — Timothy M. Morella

(57) ABSTRACT

To provide a connector capable of assuring contact pressure between a terminal and a flat cable without disposing a metal beam supporting an actuator. In the connector of the Present Application, a housing has a convexity-opposing a terminal, and an actuator has a concavity mating with the convexity. An axle disposed in the concavity is inserted into a bearing disposed on the convexity. The actuator has a cam fitting between the convexity and the terminal, and is disposed so as to be able to turn between a sandwiched position at which a flat cable is sandwiched between the cam and the terminal and a release position at which the sandwiching is released.

6 Claims, 12 Drawing Sheets

FPC CONNECTOR

REFERENCE TO RELATED APPLICATIONS

The Present Application claims priority to prior-filed Japanese Patent Application No. 2009-120778, entitled "Connector," and filed 19 May 2009, the contents of which is fully incorporated in its entirety herein.

BACKGROUND OF THE PRESENT APPLICATION

In connectors used in flexible printed circuits, flexible flat cables and other flat cables, the flat cable electrode is held in pressure contact with the connector terminal by the connector being rotatable after the flat cable is inserted into the connector.

An example is illustrated in Japanese Patent Application No. H8-279378. The '378 application purports to disclose technology in which a portion of the actuator (i.e., an insertion pressure element) is inserted between a metal beam and the terminal and pressure is applied toward the terminal by the metal beam. However, disposing this metal beam is a cause of increased cost.

The '378 application further describes disposing a rotating support point protrusion 13 and a rotating support point concavity 32 on the two lengthwise ends of the housing and the actuator. See Paragraphs 0001, 0012; and FIG. 6. However, the rotating support point protrusion 13 and the rotating support point concavity 32 are merely support points for rotation of the actuator, and do not generate any pressure force upon the actuator. Actually, the insertion pressure element 33 of the actuator is pressed upon by an attachment 23 serving as a metal beam.

Taking note of the circumstance described above, a principal aim of the Present Application is to provide a connector capable of assuring contact pressure between the terminal and the flat cable without disposing a metal beam supporting the actuator.

SUMMARY OF THE PRESENT APPLICATION

In order to solve the problem described above, the connector of the Present Application has at least one terminal, a housing to which the terminal is attached, and an actuator. The housing has at least one convexity opposing the terminal. The actuator has at least one concavity mating with the convexity, and an axle disposed in one of the convexity and the concavity is inserted into a bearing disposed in the other. In addition, the actuator has a cam fitting between the convexity and the terminal, and is disposed so as to be able to turn between a sandwiched position at which a flat cable is sandwiched between the cam and the terminal and a release position at which sandwiching is released.

According to the Present Application, the convexity on the housing is disposed opposing the terminal, and when the cam of the actuator is fitted between the convexity and the terminal, a flat cable is sandwiched between the cam and the terminal. As a result, contact pressure can be assured between the terminal and the flat cable without disposing a metal beam supporting the actuator.

In addition, in an embodiment of the Present Application, a bearing is disposed on the convexity, and the bearing is formed as a groove opened to the opposite side from the side on which the cam is disposed when the actuator is in the sandwiched position. As a result, actuator drop is inhibited in the sandwiched position.

In addition, in an embodiment of the Present Application, protrusions are formed respectively on the convexity and the concavity making mutual contact when the actuator is in the release position. As a result, the actuator is limited to rotating toward the opposite side from the sandwiched position from the release position.

Also, in an embodiment of the Present Application, the terminal is disposed flexibly deformably in a direction approaching the convexity. As a result, contact pressure between the terminal and the flat cable is increased by the plastic deformation of the terminal.

In addition, the connector of the Present Application has at least 1 terminal, a housing to which the terminal is attached, and an actuator. The housing has at least 1 convexity opposing the terminal. The actuator has at least one concavity mating with the convexity, and an axle disposed in one of the convexity and the concavity is inserted into a bearing disposed in the other. In addition, the actuator has a cam fitting between the convexity and the terminal, and is disposed so as to be able to turn between a sandwiched position at which a flat cable is sandwiched between the cam and the terminal and a release position at which sandwiching is released.

BRIEF DESCRIPTION OF THE FIGURES

The organization and manner of the structure and operation of the Present Application, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Application may be susceptible to embodiment in different forms, there is shown in the Figures, and will be described herein in detail, specific embodiments, with the understanding that the disclosure is to be considered an exemplification of the principles of the Present Application, and is not intended to limit the Present Application to that as illustrated.

In the illustrated embodiments, directional representations—i.e., up, down, left, right, front, rear and the like, used for explaining the structure and movement of the various elements of the Present Application, are relative. These representations are appropriate when the elements are in the position shown in the Figures. If the description of the position of the elements changes, however, it is assumed that these representations are to be changed accordingly.

Figure 1A:
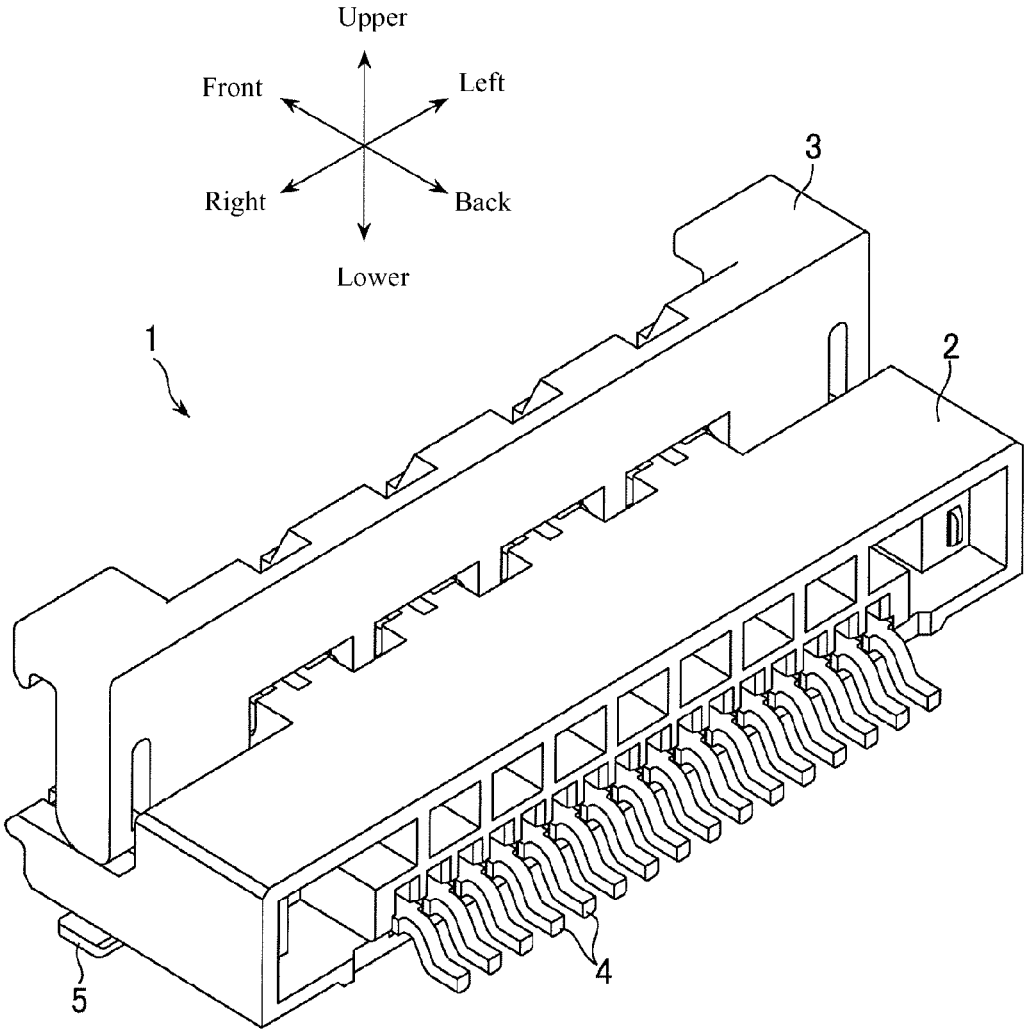
FIG. 1A illustrates an external perspective view of the connector with the actuator in the release position.
Figure 1B:
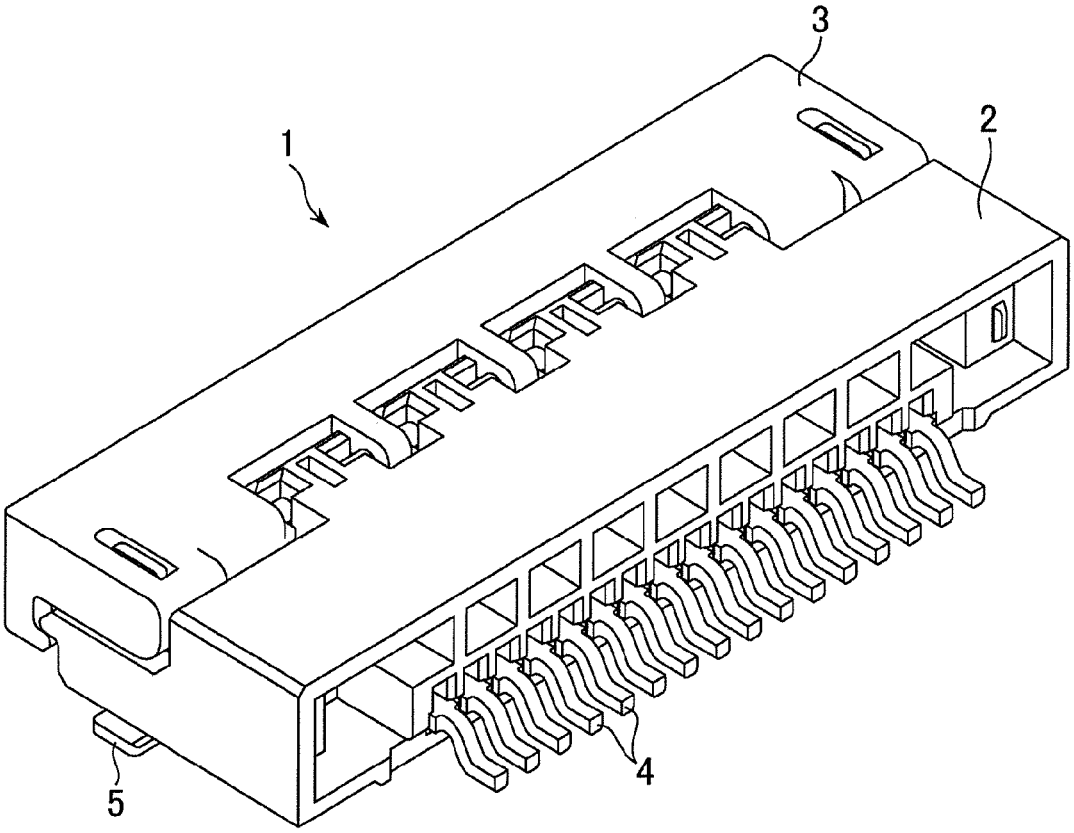
FIG. 1B illustrates an external perspective view of the connector with the actuator in the sandwiched position.

As shown in FIG. 1A and FIG. 1B, the connector 1 has a generally box-shaped housing 2 formed from resin material with insulating properties. An insertion opening 10*a* (see FIG. 4A) is disposed on the front surface of the housing 2, and a flat cable (not shown) is inserted therein.

The flat cable is a flat wiring member having plasticity, with a group of electrodes formed on terminals on one surface.

In the present embodiment, the group of electrodes is inserted into the insertion opening 10*a* directed toward the bottom. Inside the housing 2, a plurality of terminals 4 formed by bending conductive metallic thin sheets is disposed mutually in parallel a prescribed distance apart. On the upper front side of the housing 2 is attached a horizontal actuator formed from a resin material with insulating properties and extending from right to left. In addition, on the left and right edges of the housing is attached support hardware 5 formed by bending metallic thin sheets. The support hardware 5 is partially soldered to a circuit board (not shown).

Figure 2A:
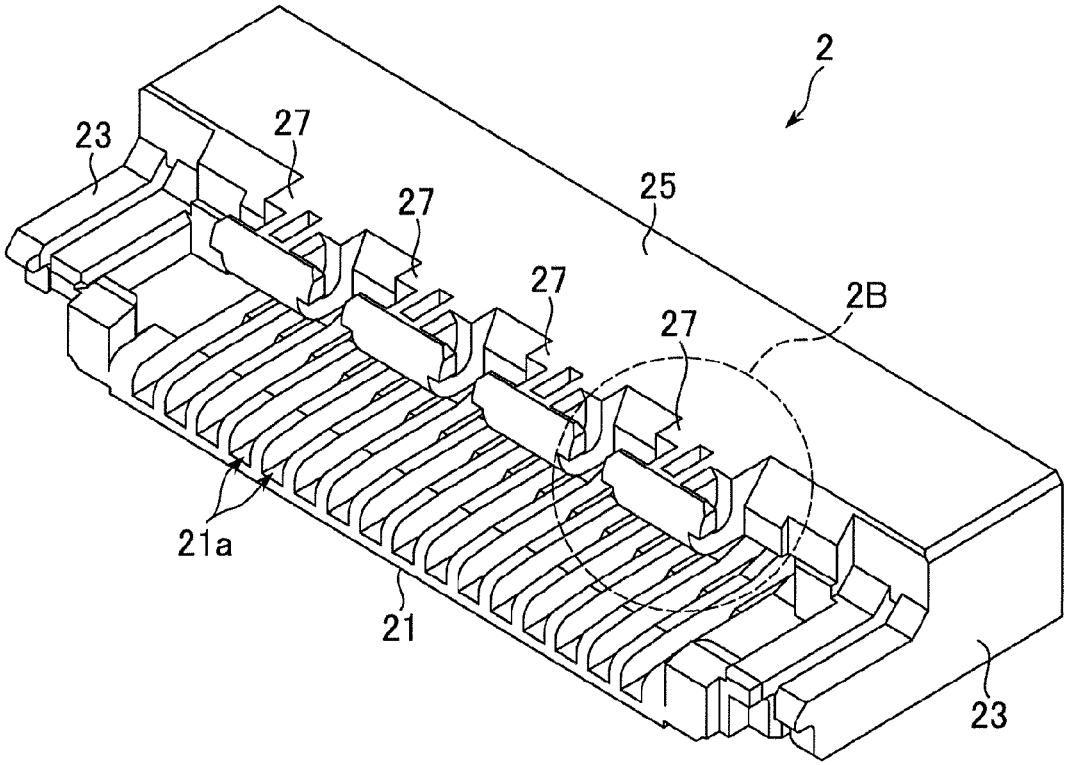
FIG. 2A illustrates an external perspective view of the housing.
Figure 4A:
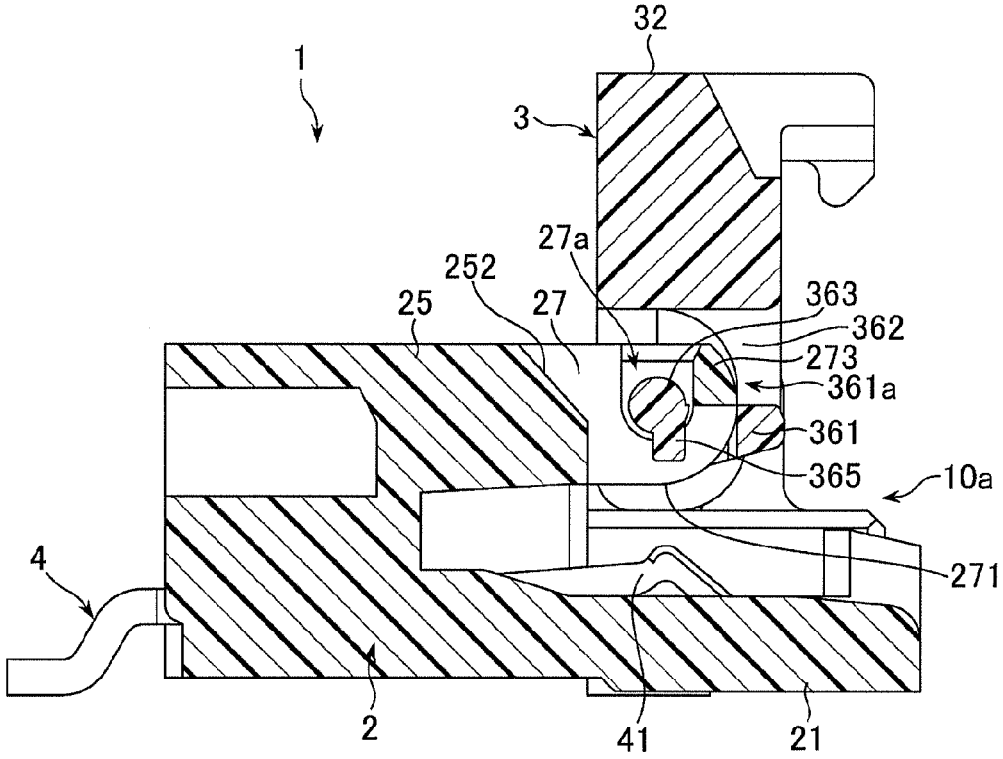
FIG. 4A illustrates a sectional view of the connector with the actuator in the release position.

As shown in FIG. 2A, the housing 2 has a bottom 21, sides 23, and a top 25, and is formed in a general box shape. On the bottom 21 is formed a plurality of terminal grooves 21 into which the terminals 4 are inserted. The top 25 is formed to cover the rear half of the bottom 21, and on the front edge thereof is disposed a plurality of convexities 27 protruding in a forward direction, arrayed lengthwise a prescribed distance apart. These convexities 27 are disposed above the terminals 4 supported on the bottom 21. Specifically, as shown in FIG. 4A, the convexities 27 are disposed above mountain-shape curved contact points 41 serving as points of contact with the flat cable.

Figure 2B:
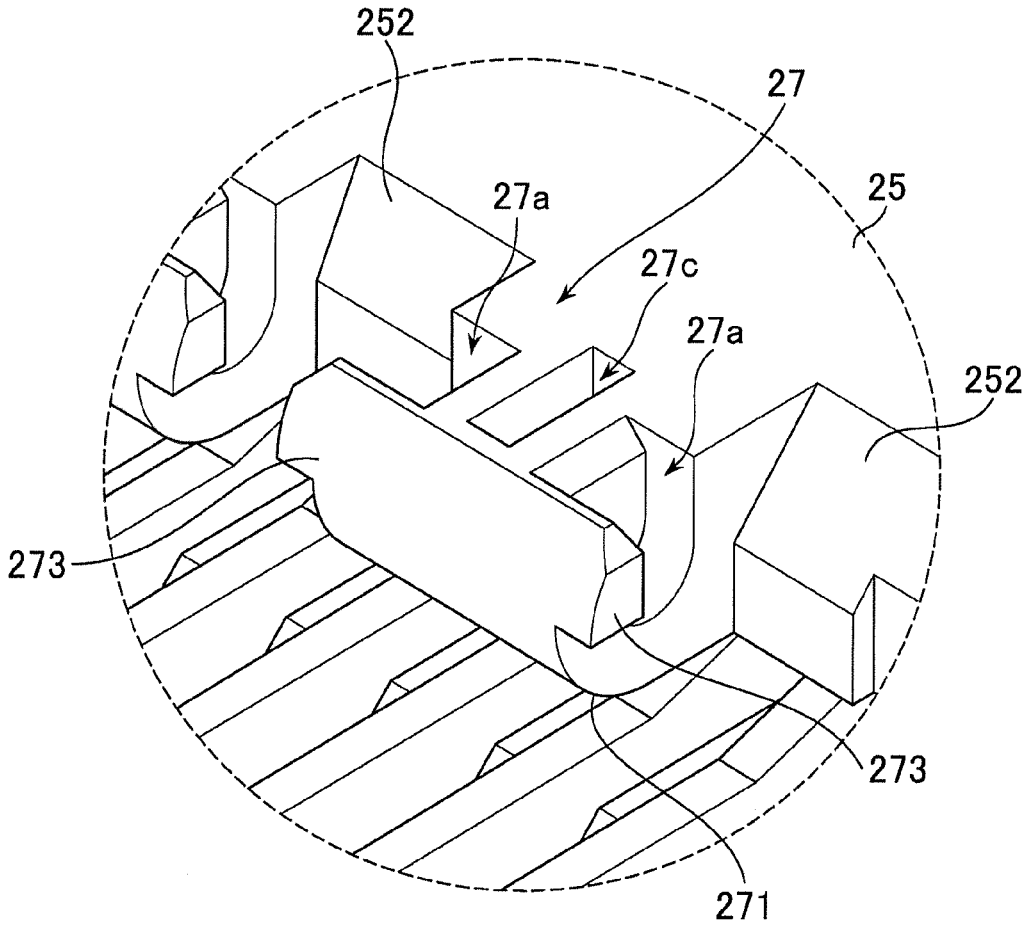
FIG. 2B illustrates an enlarged view of a portion of the housing.

As shown in FIG. 2B, bearings 27*a* are disposed on the right and left sides of the convexity 27. These bearings 27*a* are formed as U-shaped grooves opened upward, and subsequently discussed axles 363 of the actuator 3 are inserted therein. In the center of the convexity 27 a rectangular shaped notch 27*c* is disposed passing in a top-to-bottom direction between the left and right bearings 27*a*. On the front side of the bearings 27*a* are formed protrusions 273 protruding to the rear on the left and right. A perimeter surface 271 is formed centered on the bearings 27*a* from the front to the bottom of the convexity 27. Also, at the front edge of the top 25, at the left and right shoulders of the convexity 27, a tapered surface 252 is formed in a forward angular upward direction.

Figure 3A:
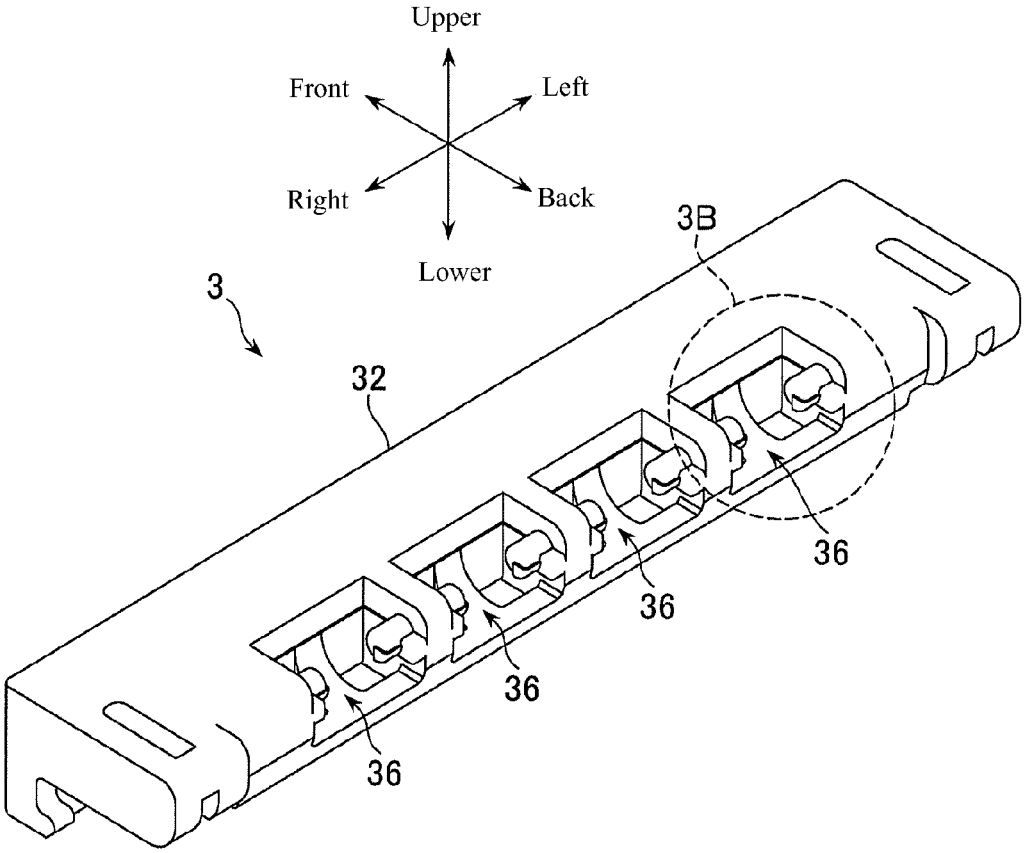
FIG. 3A illustrates an external perspective view of the actuator.

As shown in FIG. 3A, the actuator 3 is formed in an essentially horizontal sheet shape extending left and right. A lengthwise side in front of the actuator 3 serves as a control unit 32 for a user to actuate rotation of the actuator using a finger. On a lengthwise side in the rear of the actuator 3 is arrayed a plurality of concavities 36 at a prescribed distance apart. These concavities 36 correspond to the convexities 27 disposed on the housing 2.

Figure 3B:
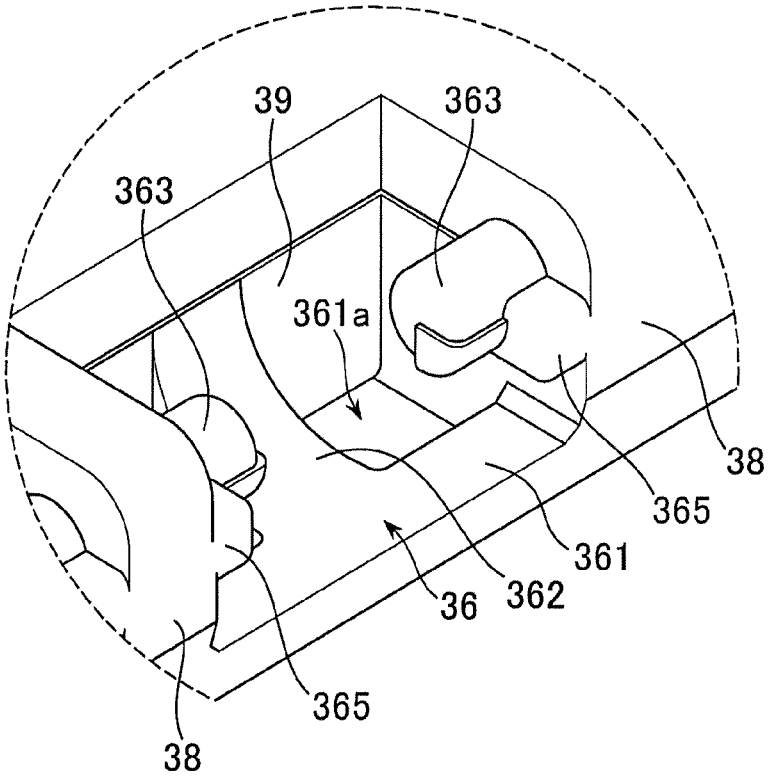
FIG. 3B illustrates an enlarged view of a portion of the actuator.

As shown in FIG. 3B, axles 363 are disposed in the concavities 36 extending toward the inside from the left and right side walls 38. The tips of the axles 363 are inserted into the bearings 27*a* on the housing 2. At the rear of the base ends of the axles 363, protrusions 365 are formed continuous with the base ends of the axles 363. Cams 361 are disposed at the lower rear edge of the interior of the concavities 36 extending left and right and linking the paired side walls 38. These cams 361 are disposed underneath the protrusions 365. At the center of the front side of the cams 361, ribbed sections 362 are disposed linking the cams 361 with the front wall 39. On the left and right shoulders of the ribbed sections 362 are disposed notches 361 running through in a top-to-bottom direction. The outer surface of the ribbed sections 362 serves as a perimeter surface centered on the axles 363.

As shown in FIG. 4A, configured thusly, the actuator 3 is attached to the housing 2 in an upright posture. Specifically, because of the fact that the axles 363 disposed in the concavities 36 of the actuator 3 are inserted from the top side of the bearings 27*a* disposed on the convexities 27 of the housing 2, the concavities 36 of the actuator 3 are able to mate with the convexities 27 of the housing 2. The position of the actuator 3 at this time is an example of the release position. At this time, a gap is formed between the convexities 27 and the terminals 4, and the flat cable is inserted into this gap from the insertion opening 10*a*.

Figure 4B:
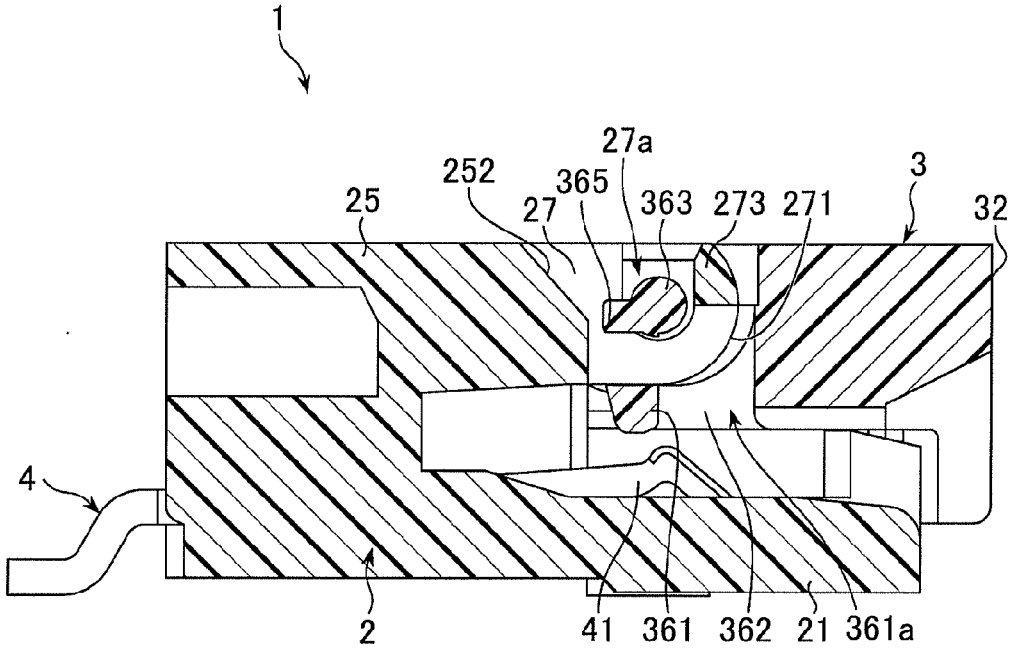
FIG. 4B illustrates a sectional view of the connector with the actuator in the sandwiched position.

In addition, when the control unit 32 is actuated by a user, the actuator 3 turns between the release position and the sandwiched position in a tipped-forward attitude shown in FIG. 4B.

When the actuator turns from the release position to the sandwiched position, the cams 361 disposed in front of the convexities 27 move downward and to the rear, fitting into the space between the convexities 27 and the terminals 4. At this time, the flat cable is sandwiched between the cams 361 and the terminals 4. In addition, at this time, the terminals 4 are depressed by the cams 361, thereby generating return pressure force, or in other words, sandwiching force on the flat cable due to plastic deformation.

Figure 5:
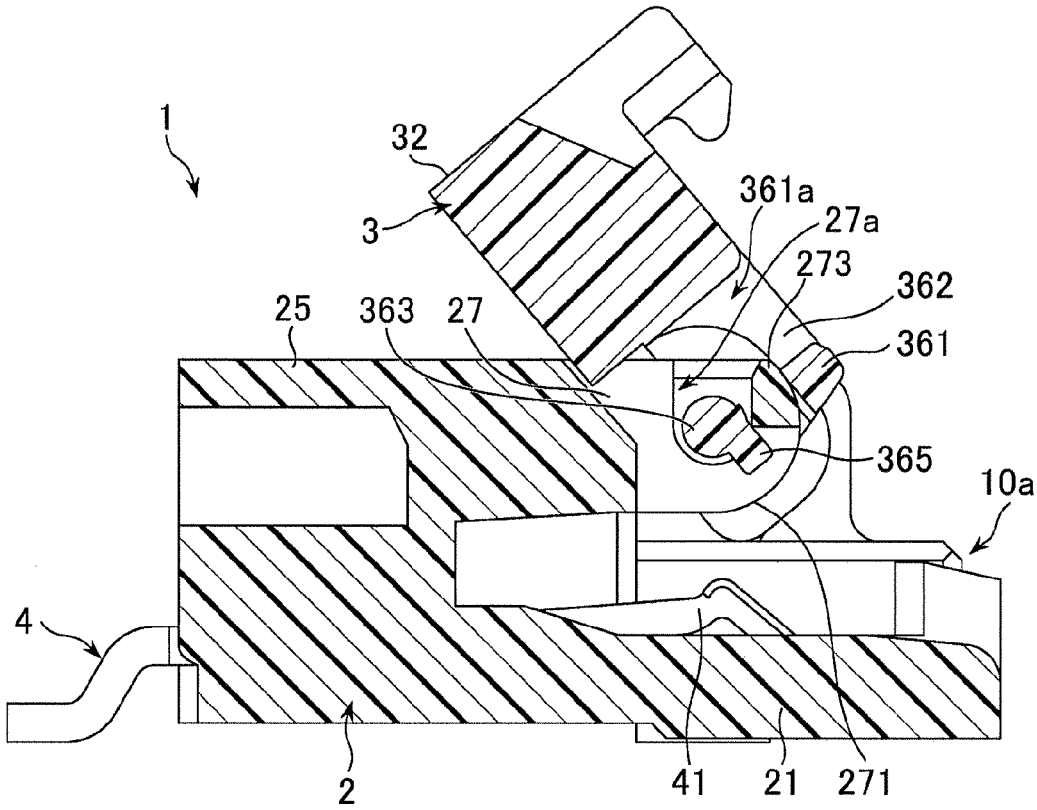
FIG. 5 is a drawing describing the contact between the pair of protrusions.

As shown in FIG. 5, when the actuator 3 is somewhat tilted to the rear, contact occurs between the protrusions 365 disposed on the shoulders of the axles 363 on the actuator 3 and the protrusions 273 disposed on the front of the bearing 27*a* of the housing 2. Accordingly, the actuator is restricted from turning more than this amount to the rear. As a result, the axles 363 of the actuator 3 will not come off even if further turning force is applied to the rear in the actuator 3 release position.

Figure 6A:
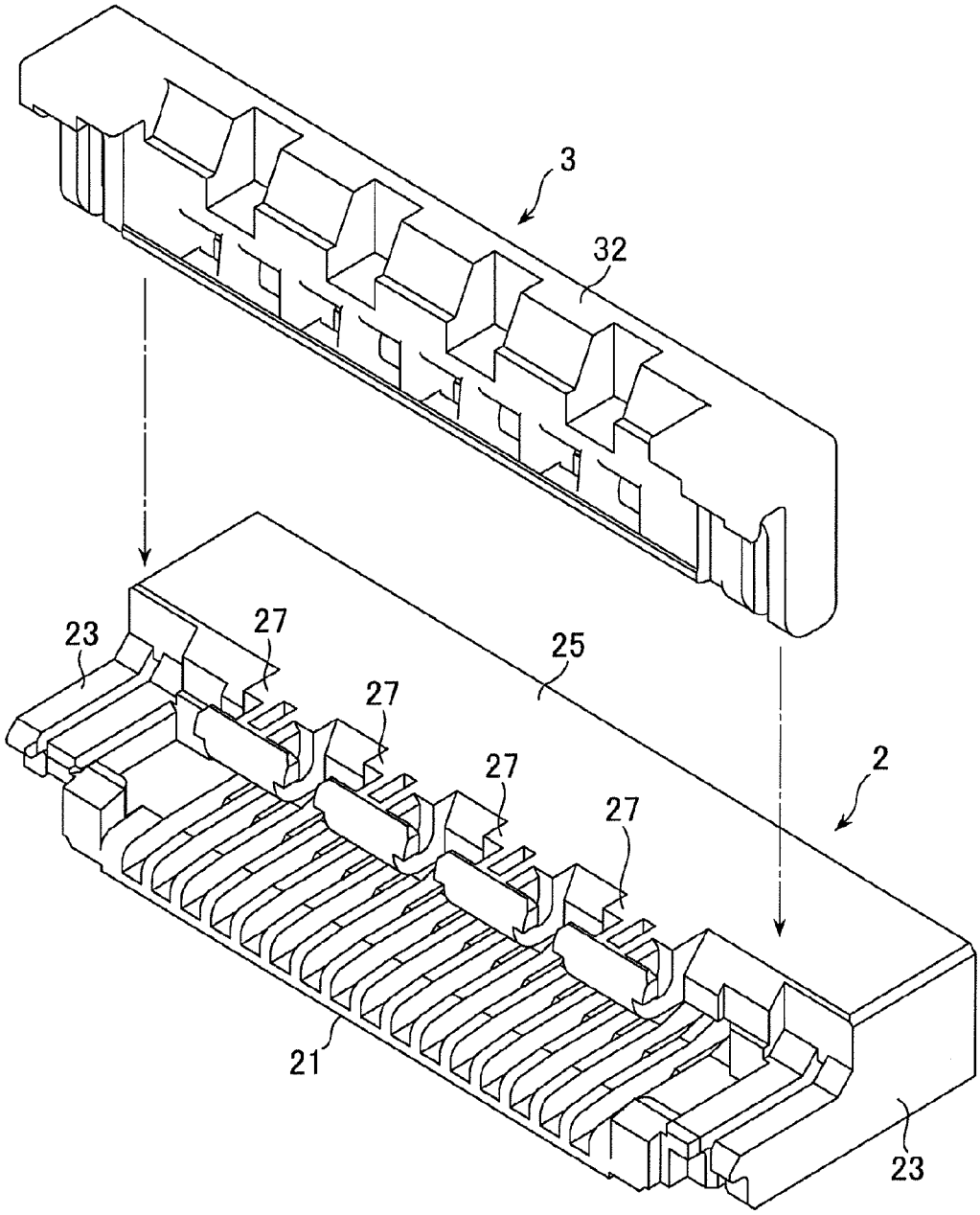
FIG. 6A is a first drawing describing the assembly of the connector.
Figure 6B:
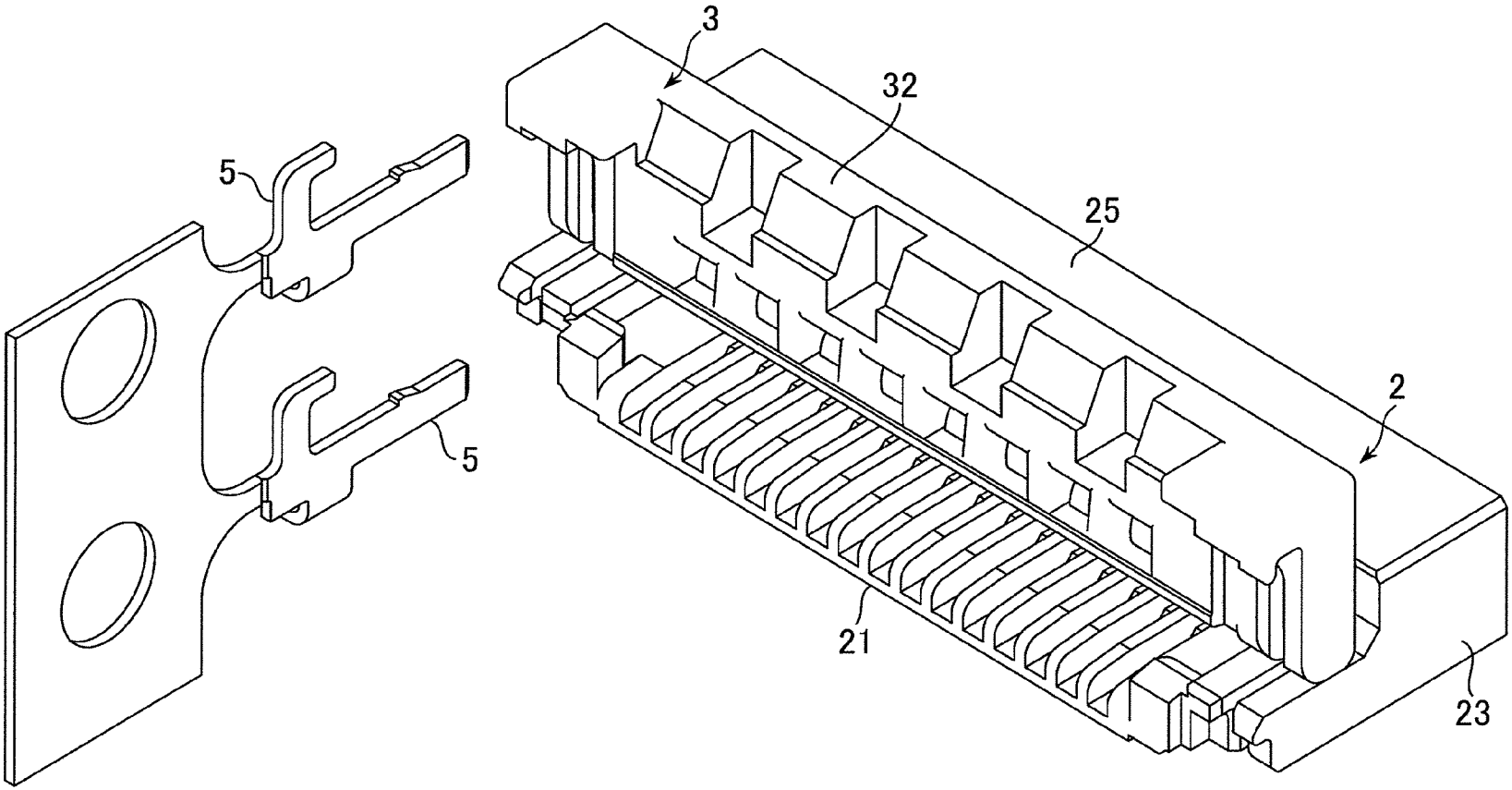
FIG. 6B is a second drawing describing the assembly of the connector.

The following section describes assembly of the connector 1. First, as shown in FIG. 6A, the actuator 3 is moved downward in an upright posture and attached to the housing 2. At this time, as discussed previously, the axles 363 disposed in the concavities 36 of the actuator 3 are inserted from above into the bearings 27*a* disposed in the convexities 27 of the housing 2 (see FIG. 4A). Next, as shown in FIG. 6B, support hardware 5 is attached to the left and right edges of the housing 2 in order to partially solder to a circuit board (not shown). In addition, as shown in FIG. 6C, a plurality of terminals 4 is inserted at once into the housing 2 from the rear.

Figure 6C:
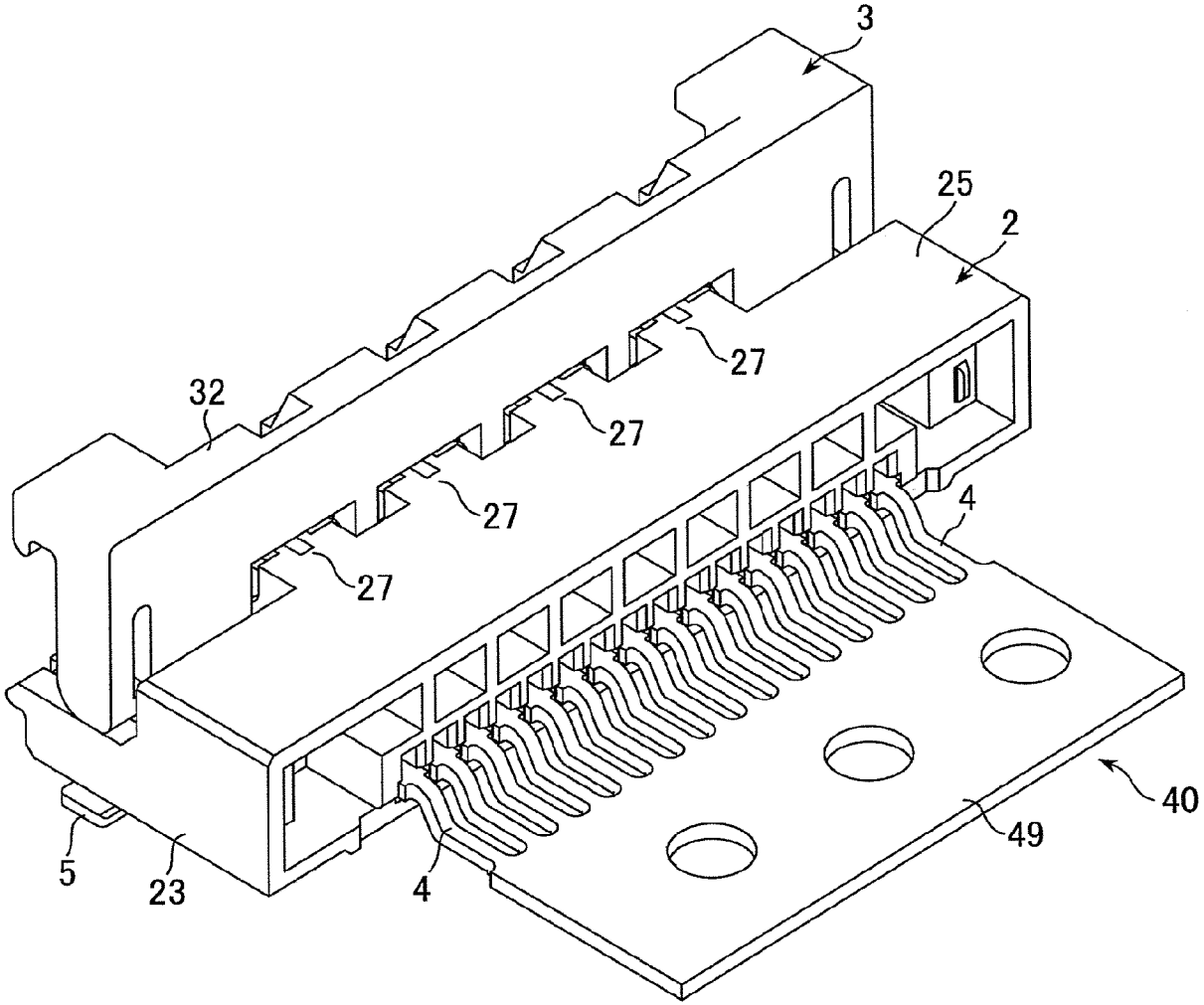
FIG. 6C is a third drawing describing the assembly of the connector.

As shown in FIG. 6C, the terminals 4 are formed as part of a terminal cluster 40. This terminal cluster 40 has a shape in which the plurality of terminals 4 is held onto a base 49, and is formed into this shape from a single metallic thin sheet. By producing this terminal cluster 40, it is possible to press the plurality of terminals 4 into the housing 2 all at once.

According to the present embodiment as described above, as shown in FIG. 4B, the convexities 27 of the housing 2 are disposed above the contact points 41 serving as contact points with the flat cable from among the terminals 4 held onto the housing 2. When the actuator 3 is disposed in the sandwiched position, the cams 361, which are a part of the actuator 3, fit into the gap between the convexities 27 and the terminals 4. At this time, since the flat cable is sandwiched between the contact points 41 for the cams 361 and the terminals 4, contact pressure can be secured between the contact points 41 of the terminals 4 and the electrodes of the flat cable.

In addition, as shown in FIG. 4B, in the present embodiment, the bearings 27*a* disposed on the sides of the convexities 27 of the housing 2 are formed as U-shaped grooves opened upward, and the axles 363 disposed in the concavities 36 of the actuator 3 are inserted into the bearings 27*a*. Moreover, when the actuator 3 is in the sandwiched position, the cams 361, which are part of the actuator 3, are disposed below the convexities 27 of the housing 2, so the actuator 2 will not fall off in any direction.

Also, in the present embodiment, protrusions 273 are disposed in front of the bearings 27*a* of the housing 2, as shown in FIG. 2B, and protrusions 365 are disposed on the shoulders of the axles 363 of the actuator 3, as shown in FIG. 3B. These protrusions 273 and protrusions 365 make contact when the actuator 3 is tilted to the rear as shown in FIG. 5, thereby limiting the actuator 3 from turning to the rear to a greater amount. As a result, the axles 363 of the actuator 3 will not come off even if additional turning force is applied to the rear with the actuator 3 in the release position.

In addition, in the present embodiment, the terminals 4 are formed by bending a metallic thin sheet, and are configured to be flexibly deformable upward and downward, which is the direction of sheet pressure. As a result, when the actuator 3 turns to the sandwiched position and the cams 361, which are part of the actuator 3, fit into the space between the convexities 27 and the terminals 4, the terminals 4 are depressed by the cams 361.

As a result, contact pressure is increased between the contact points 41 of the terminals 4 and the electrodes of the flat cable due to the plastic deformation of the terminals 4.

The preceding section has described an embodiment of the Present Application. However, the Present Application is not limited to the embodiment described above, and a person of ordinary skill in the art may of course implement various modifications.

Figure 7:
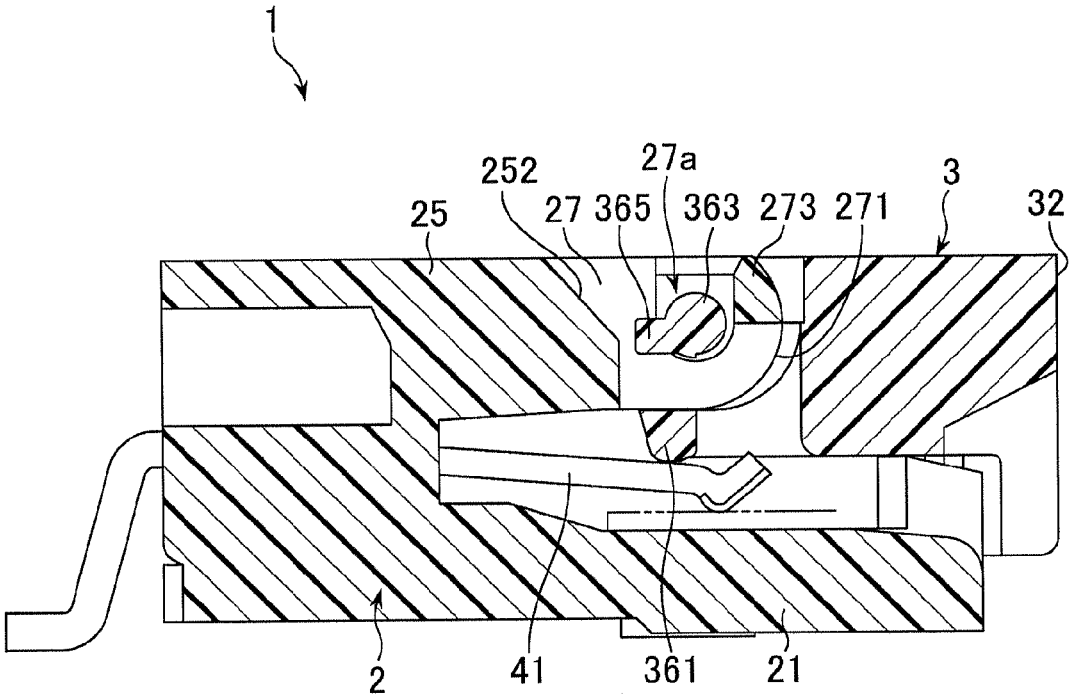
FIG. 7 illustrates a sectional view showing a modified example.

For example, in the embodiment described above, the flat cable is sandwiched into the space between the cams 361, which are part of the actuator 3, and the terminals 4. But conversely, as shown in FIG. 7, the terminals 4 may also be sandwiched into the space between the cams 361 and the flat cable.

The intent of the Present Application is not to remove the metal beam supporting the actuator, but to further enhance pressure force on the actuator by combining a metal beam supporting the actuator with the configuration of the Present Application described above.

What is claimed is:

1. A connector, the connector comprising:

at least one terminal;

a housing, the housing being attached to the terminal and including at least one convexity, the convexity disposed opposite the terminal;

an actuator, the actuator including at least one concavity, the concavity mating with the convexity, the actuator receiving an axle, the axle disposed on either of the convexity or the concavity, the axle being inserted into a bearing disposed on the other of the convexity or the concavity, the axle having an axis; and a cam, the cam disposed between the convexity and the terminal and being able to turn between a sandwiched position, at which a flat cable is sandwiched between the cam and the terminal, and a release position, at which sandwiching is released;

wherein the actuator, when the cam turns between the sandwiched position and the release position, rotates about the axis while the bearing prevents movement of the actuator beyond the axis.

2. The connector of claim 1, wherein the bearing is disposed on the convexity.

3. The connector of claim 1, wherein protrusions are formed respectively on the convexity and the concavity, making mutual contact when the actuator is in the release position.

4. The connector of claim 1, wherein the terminal is disposed flexibly and deformably in a direction approaching the convexity.

5. A connector, the connector comprising:

at least one terminal;

a housing, the housing being attached to the terminal and including at least one convexity, the convexity disposed opposite the terminal;

an actuator, the actuator including at least one concavity, the concavity mating with the convexity, the actuator receiving an axle, the axle disposed on either of the convexity or the concavity, the axle being inserted into a bearing disposed on the other of the convexity or the concavity, the axle having an axis; and a cam, the cam disposed between the convexity and the terminal and being able to turn between a sandwiched position, at which the terminal is sandwiched between the cam and a flat cable, and a release position, at which holding is released;

wherein the actuator, when the cam turns between the sandwiched position and the release position, rotates about the axis while the bearing prevents movement of the actuator beyond the axis.

6. The connector of claim 2, wherein the bearing is formed as a groove opened to the opposite side from the side on which the cam is disposed when the actuator is in the sandwiched position.

* * * * *